US010556333B2

(12) United States Patent
Wirnitzer et al.

(10) Patent No.: US 10,556,333 B2
(45) Date of Patent: Feb. 11, 2020

(54) MACHINE-TOOL DEVICE

(71) Applicant: Robert Bosch GmbH, Stuttgart (DE)

(72) Inventors: Bernd Wirnitzer, Friolzheim (DE); Helge Sprenger, Stuttgart (DE); Hagen Philipp Keinath, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 452 days.

(21) Appl. No.: 15/036,281

(22) PCT Filed: Nov. 6, 2014

(86) PCT No.: PCT/EP2014/073924

§ 371 (c)(1),
(2) Date: May 12, 2016

(87) PCT Pub. No.: WO2015/082169

PCT Pub. Date: Jun. 11, 2015

(65) Prior Publication Data

US 2016/0279776 A1 Sep. 29, 2016

(30) Foreign Application Priority Data

Dec. 3, 2013 (DE) ..... 10 2013 224 759

(51) Int. Cl.
*B25D 11/00* (2006.01)
*B25F 5/00* (2006.01)

(52) U.S. Cl.
CPC ..... *B25D 11/005* (2013.01); *B25F 5/00* (2013.01); *B25D 2250/201* (2013.01); *B25D 2250/221* (2013.01)

(58) Field of Classification Search
CPC ..... B25D 2250/221; B25D 11/005; B25D 2250/201; B25D 11/00; B25F 5/00
(Continued)

(56) References Cited

U.S. PATENT DOCUMENTS 3,665,493 A * 5/1972 Glowzewski ..... G05B 19/4163 318/561
4,454,459 A * 6/1984 Huber ..... H02P 25/145 318/484
(Continued)

FOREIGN PATENT DOCUMENTS

CN 201152938 Y 11/2008
CN 201499120 U 6/2010
(Continued)

OTHER PUBLICATIONS

International Search Report corresponding to PCT Application No. PCT/EP2014/073924, dated Feb. 4, 2015 (German and English language document) (7 pages).

*Primary Examiner* — Robert F Long
(74) *Attorney, Agent, or Firm* — Maginot, Moore & Beck LLP

(57) ABSTRACT

A machine-tool device includes at least one control and/or regulation unit. The at least one control and/or regulation unit is configured to (i) at least one of control and/or regulation of a drive unit and (ii) determine at least one actual rotational speed of the drive unit from a signal of at least one sensor element taking the form of an acceleration sensor. The machine-tool device further includes at least one sensor unit which includes the at least one sensor element taking the form of the acceleration sensor.

11 Claims, 3 Drawing Sheets

(58) Field of Classification Search
USPC ..... 173/2–11, 176–183
See application file for complete search history.

(56) References Cited

U.S. PATENT DOCUMENTS 4,487,270 A * 12/1984 Huber ..... B23B 45/02 173/176
4,580,640 A * 4/1986 Boldt ..... E21B 1/02 173/10
4,661,756 A * 4/1987 Murphy ..... H02P 25/08 310/168
5,014,794 A * 5/1991 Hansson ..... B23Q 15/08 173/181
5,142,210 A * 8/1992 Kojima ..... G05B 19/4062 318/275
5,522,695 A * 6/1996 Franetzki ..... A61C 1/05 415/35
5,561,355 A * 10/1996 Ideguchi ..... G05B 19/232 318/432
5,728,949 A * 3/1998 McMillan ..... G01F 1/06 73/861.77
6,604,666 B1 * 8/2003 Pedicini ..... B25C 1/06 173/124
7,172,034 B2 * 2/2007 Makiyama ..... B23B 35/00 173/1
8,324,845 B2 * 12/2012 Suzuki ..... B25F 5/00 318/139
8,552,669 B2 * 10/2013 Kusakawa ..... H02P 7/29 318/139
9,314,855 B2 * 4/2016 Ookubo ..... B23B 45/02
9,815,160 B2 * 11/2017 Nitsche ..... B25D 16/006
2002/0108474 A1 * 8/2002 Adams ..... B25C 1/06 81/487
2002/0134172 A1 * 9/2002 Yamada ..... B25B 21/02 73/862.21
2002/0185514 A1 * 12/2002 Adams ..... B25C 1/008 227/2
2003/0173096 A1 * 9/2003 Setton ..... B23P 19/066 173/176
2004/0200628 A1 * 10/2004 Schmitzer ..... B25D 16/006 173/1
2005/0000998 A1 * 1/2005 Grazioli ..... B25B 27/0085 227/2
2005/0109519 A1 * 5/2005 Kawai ..... B25B 21/026 173/183
2006/0243469 A1 * 11/2006 Webster ..... A47J 43/1037 173/217
2007/0084613 A1 4/2007 Zhang et al.
2008/0110653 A1 * 5/2008 Zhang ..... B23D 59/001 173/1
2008/0289839 A1 * 11/2008 Hricko ..... B25B 21/00 173/1
2010/0089600 A1 * 4/2010 Borinato ..... B23P 19/066 173/1
2010/0193205 A1 * 8/2010 Cecchin ..... B25D 11/005 173/5
2010/0263890 A1 * 10/2010 Profunser ..... B25B 21/02 173/1
2010/0307782 A1 * 12/2010 Iwata ..... B25F 5/00 173/1
2011/0139473 A1 * 6/2011 Braun ..... B25D 16/003 173/20
2011/0180284 A1 * 7/2011 Carrier ..... B25F 5/00 173/1
2011/0284255 A1 * 11/2011 Ookubo ..... B23B 45/02 173/109
2011/0303427 A1 * 12/2011 Tang ..... B23P 19/066 173/1
2012/0103643 A1 * 5/2012 Binder ..... B25D 16/003 173/2
2012/0274254 A1 * 11/2012 Muller ..... B25F 5/00 318/446
2012/0318545 A1 * 12/2012 Schreiber ..... B25F 3/00 173/1
2013/0000938 A1 * 1/2013 Matsunaga ..... B25B 21/008 173/181
2013/0056235 A1 * 3/2013 Pozgay ..... B25B 21/00 173/29
2013/0133911 A1 * 5/2013 Ishikawa ..... B25B 21/00 173/176
2013/0133912 A1 * 5/2013 Mizuno ..... B25B 23/1405 173/180
2013/0140050 A1 * 6/2013 Eshleman ..... B25B 21/00 173/1
2013/0228353 A1 * 9/2013 Chen ..... B25B 23/1475 173/1
2013/0269961 A1 * 10/2013 Lim ..... B25F 5/001 173/1
2013/0327552 A1 * 12/2013 Lovelass ..... B25F 5/00 173/1
2014/0048298 A1 * 2/2014 Fuchs ..... B25B 21/00 173/1
2014/0367134 A1 * 12/2014 Phillips ..... B25F 5/00 173/176
2015/0042246 A1 * 2/2015 Tadokoro ..... B25F 5/00 318/114
2015/0108926 A1 * 4/2015 Wiszniewski ..... H02P 3/18 318/245
2015/0129248 A1 * 5/2015 Nitsche ..... B25D 16/006 171/1
2017/0099025 A1 * 4/2017 Ma ..... B25F 5/00
2017/0268723 A1 * 9/2017 Kolb ..... A01G 3/053

FOREIGN PATENT DOCUMENTS

CN 102528770 A 7/2012
DE 10 2012 205 714 A1 10/2013
EP 1 502 710 A2 2/2005
EP 1 607 186 A1 12/2005
RU 2011 101 776 A 7/2012

* cited by examiner

MACHINE-TOOL DEVICE

This application is a 35 U.S.C. § 371 National Stage Application of PCT/EP2014/073924, filed on Nov. 6, 2014, which claims the benefit of priority to Serial No. DE 10 2013 224 759.1, filed on Dec. 3, 2013 in Germany, the disclosures of which are incorporated herein by reference in their entirety.

BACKGROUND

Machine-tool devices, particularly manual machine-tool devices, are already known that exhibit a control and/or regulation unit, for control and/or regulation of a drive unit, and at least one sensor unit, said sensor unit including at least one sensor element taking the form of an acceleration sensor.

SUMMARY

The disclosure takes as its starting-point a machine-tool device, in particular a manual machine-tool device, with at least one control and/or regulation unit, for control and/or regulation of a drive unit, and with at least one sensor unit which includes at least one sensor element taking the form of an acceleration sensor.

It is proposed that the control and/or regulation unit is provided at least to determine at least one actual rotational speed of the drive unit from a signal of the sensor element taking the form of an acceleration sensor. The term "provided" is to be understood to mean, in particular, specially programmed, specially designed and/or specially equipped. A statement that an element and/or a unit is provided for a particular function is to be understood to mean, in particular, that the element and/or the unit fulfil(s) and/or perform(s) this particular function in at least one application condition and/or operating condition. The machine-tool device preferably takes the form of a manual-machine-tool regulation device which is provided for regulation of a set rotational speed of the drive unit. The drive unit preferably takes the form of an electric-motor unit. In this case, the drive unit may take the form of an a.c. electric-motor unit or a d.c. motor unit. The control and/or regulation unit is preferably provided to control and/or regulate a rotational speed of the drive unit. A "control and/or regulation unit" is to be understood to mean, in particular, a unit with at least one electronic control circuit. An "electronic control circuit" is to be understood to mean, in particular, a unit with a processor unit and with a memory unit and also with an operating program stored in the memory unit. The control and/or regulation unit preferentially receives electrical signals of the sensor unit, which are taken into account in the course of control and/or regulation of the drive unit. For this purpose, the control and/or regulation unit has preferentially been connected to the sensor unit at least electrically and/or for data processing. In this case the control and/or regulation unit may have been connected to the sensor unit in hard-wired or wireless manner. The control and/or regulation unit includes, in particular, an operating program and/or an operating function that exhibit(s) at least one algorithm for determination of an actual rotational speed of the drive unit from a signal of the sensor element taking the form of an acceleration sensor. The actual rotational speed of the drive unit can preferentially be determined by means of a Fourier analysis, by means of a phase-locked loop (PLL) and/or by means of a frequency comb (covariance) from a signal of the sensor element taking the form of an acceleration sensor. In addition, a determination of rotational speed by means of a method for determination of a cycle duration from a time signal is conceivable, in which a time between two signal peaks or two zero crossings of the acceleration signal is measurable and a frequency is ascertainable therefrom. Depending on a signal quality, in this case a preprocessing by means of a band-pass filter is appropriate. Alternatively, the time between several signal peaks or zero crossings is ascertainable, as a result of which the calculated frequency has been averaged over several periods.

The sensor element taking the form of an acceleration sensor is preferentially provided to record acceleration values that are oriented at least substantially parallel to a drive axis, in particular an axis of rotation, of the drive unit and/or that are oriented at least substantially parallel to an axis of rotation of a tool socket of the machine tool. However, it is also conceivable that the sensor element taking the form of an acceleration sensor is alternatively or additionally provided to record acceleration values that are oriented at least substantially perpendicular to a drive axis, in particular an axis of rotation, of the drive unit. The term "substantially parallel" here is to be understood to mean, in particular, an orientation of a direction relative to a reference direction, in particular in a plane, said direction exhibiting a deviation in relation to the reference direction of, in particular, less than 8°, advantageously less than 5°, and particularly advantageously less than 2°. The expression "substantially perpendicular" here is intended to define, in particular, an orientation of a direction relative to a reference direction, said direction and said reference direction including, in particular viewed in a plane, an angle of 90°, and said angle exhibiting a maximum deviation of, in particular, less than 8°, advantageously less than 5°, and particularly advantageously less than 2°. Particularly preferably, the sensor element taking the form of an acceleration sensor is provided to record acceleration values caused by a striking-mechanism unit. By means of the configuration, according to the disclosure, of the machine-tool device, an inexpensive device for determination of an actual rotational speed of the drive unit can be realized advantageously. Speed sensors that are already known and that have been arranged on a fan wheel, for example, can therefore be dispensed with advantageously. Consequently a saving can advantageously be made on production costs, assembly costs and assembly effort, since high manufacturing tolerances in the region of the fan wheel are possible as a consequence of elimination of a speed sensor arranged on the fan wheel.

The control and/or regulation unit is advantageously provided at least to adjust a rotational speed of the drive unit as a function of a signal of the sensor element taking the form of an acceleration sensor. By this means, an adjustment of a rotational speed of the drive unit can be obtained in structurally simple manner. In addition, costs for a device for adjustment of the rotational speed of the drive unit can consequently be kept down advantageously.

Moreover, it is proposed that the sensor unit exhibits at least one further sensor element taking the form of a current sensor. The further sensor element taking the form of a current sensor is preferably provided for measurement of a drive-unit current, in particular a current consumed by the drive unit. Consequently a further characteristic quantity of the drive unit can advantageously be registered which can be utilized for further processing by means of the control and/or regulation unit.

Furthermore, it is proposed that the control and/or regulation unit is provided at least to adjust a rotational speed of the drive unit as a function of a signal of the sensor element taking the form of an acceleration sensor and as a function of a signal of the further sensor element taking the form of a current sensor. A recognition of an operating condition, in particular a striking mode or an idling mode of a striking-mechanism unit, can advantageously be made possible. Consequently an advantageous adaptation of a rotational speed of the drive unit to an operating condition can be undertaken. In one configuration of a manual machine tool with a striking-mechanism device, including the machine-tool device, in addition a safe starting of the striking-mechanism device can be obtained advantageously, since the striking-mechanism device can be started up from a low initial striking-rate. Furthermore, as a consequence of an adaptation of a rotational speed of the drive unit to an operating condition, an increase in power of the striking-mechanism device can be obtained advantageously. In addition, a low-vibration behavior of the manual machine tool in idling mode can advantageously be made possible as a consequence of a low rotational speed.

In addition, it is proposed that the sensor unit exhibits at least one additional sensor element taking the form of a voltage sensor. The additional sensor element taking the form of a voltage sensor is preferably provided for measurement of a drive-unit voltage, in particular a voltage picked up by the drive unit. Consequently a further characteristic quantity of the drive unit can advantageously be registered which can be utilized for further processing by means of the control and/or regulation unit.

Moreover, it is proposed that the control and/or regulation unit is provided at least to adjust a rotational speed of the drive unit as a function of a signal of the sensor element taking the form of an acceleration sensor, as a function of a signal of the further sensor element taking the form of a current sensor, and as a function of a signal of the additional sensor element taking the form of a voltage sensor. By means of the configuration according to the disclosure, an actual rotational speed of the drive unit can advantageously be determined which can be utilized for exact adjustment of a set rotational speed of the drive unit. Consequently an exact adjustment of a set rotational speed of the drive unit can advantageously be undertaken in ongoing operation of the drive unit.

It is furthermore proposed that the control and/or regulation unit includes at least one voltage and/or current regulator for adjustment of the rotational speed of the drive unit, which is provided to take into account a characteristic quantity of the rotational speed that has been generated from a signal of the sensor element taking the form of an acceleration sensor. In addition, the voltage and/or current regulator for adjustment of the rotational speed preferentially additionally take(s) into account the signals of the further sensor element taking the form of a current sensor, and of the additional sensor element taking the form of a voltage sensor, for adjustment of the rotational speed. Advantageously, a deviation of a set rotational speed of the drive unit can advantageously be kept small, since an actual rotational speed of the drive unit is capable of being taken into account in the course of a regulation of a rotational speed by means of the voltage and/or current regulator.

In addition, a machine tool, in particular a manual machine tool, with at least one machine-tool device according to the disclosure is proposed. A "manual machine tool" here is to be understood to mean, in particular, a machine tool for machining of workpieces that is able to be transported by an operator without a transporting machine. The manual machine tool has, in particular, a mass that is less than 40 kg, preferably less than 10 kg, and particularly preferably less than 5 kg. Particularly preferably, the machine tool takes the form of a drilling hammer and/or chipping hammer. However, it is also conceivable that the machine tool exhibits a different configuration appearing appropriate to a person skilled in the art, such as, for example, a configuration as a drilling machine, as a cordless screwdriver, as an angle-grinder, as a jigsaw, as a sabre saw, as a gardening machine etc. The machine tool, in particular the manual machine tool, may in this connection take the form of a battery-operated or power-cable-operated machine tool. By means of the configuration according to the disclosure, a precise adjustment of a rotational speed of the drive unit of the machine tool can be realized advantageously. Consequently a specific rotational speed for a machining case can advantageously be adjusted exactly. This can advantageously lead to a precise result of working.

Moreover, a method is proposed for control and/or regulation of a rotational speed of a drive unit of a machine tool with at least one machine-tool device according to the disclosure. A precise regulation of the drive unit can be realized advantageously.

Furthermore, with regard to the method according to the disclosure it is proposed that the control and/or regulation unit determines at least one frequency of a periodic acceleration, by means of which an actual rotational speed of the drive unit can be determined. Consequently an inexpensive registration of an actual rotational speed of the drive unit can be realized which can be utilized particularly advantageously for adjustment of a set rotational speed of the drive unit.

In addition, with regard to the method according to the disclosure it is proposed that the control and/or regulation unit carries out at least one adaptation of a parameter characteristic of the drive unit which has been saved in a memory unit of the control and/or regulation unit for adjustment of a set rotational speed of the drive unit. In ongoing operation an application-specific adjustment of a parameter characteristic can advantageously be made possible which enables a precise adjustment of a set rotational speed.

The machine-tool device according to the disclosure, the machine tool according to the disclosure and/or the method according to the disclosure is/are not intended to be restricted to the application and practical form described above. In particular, the machine-tool device according to the disclosure, the machine tool according to the disclosure and/or the method according to the disclosure may, for fulfilment of a mode of operation described herein, exhibit a number of individual elements, components and units differing from a number stated herein.

BRIEF DESCRIPTION OF THE DRAWINGS

Further advantages arise out of the following description of the drawing. Embodiments of the disclosure are represented in the drawing. The drawing, the description and the claims contain numerous features in combination. A person skilled in the art will expediently also consider the features individually and will combine them to form meaningful further combinations.

Shown are.

DETAILED DESCRIPTION

Figure 1:
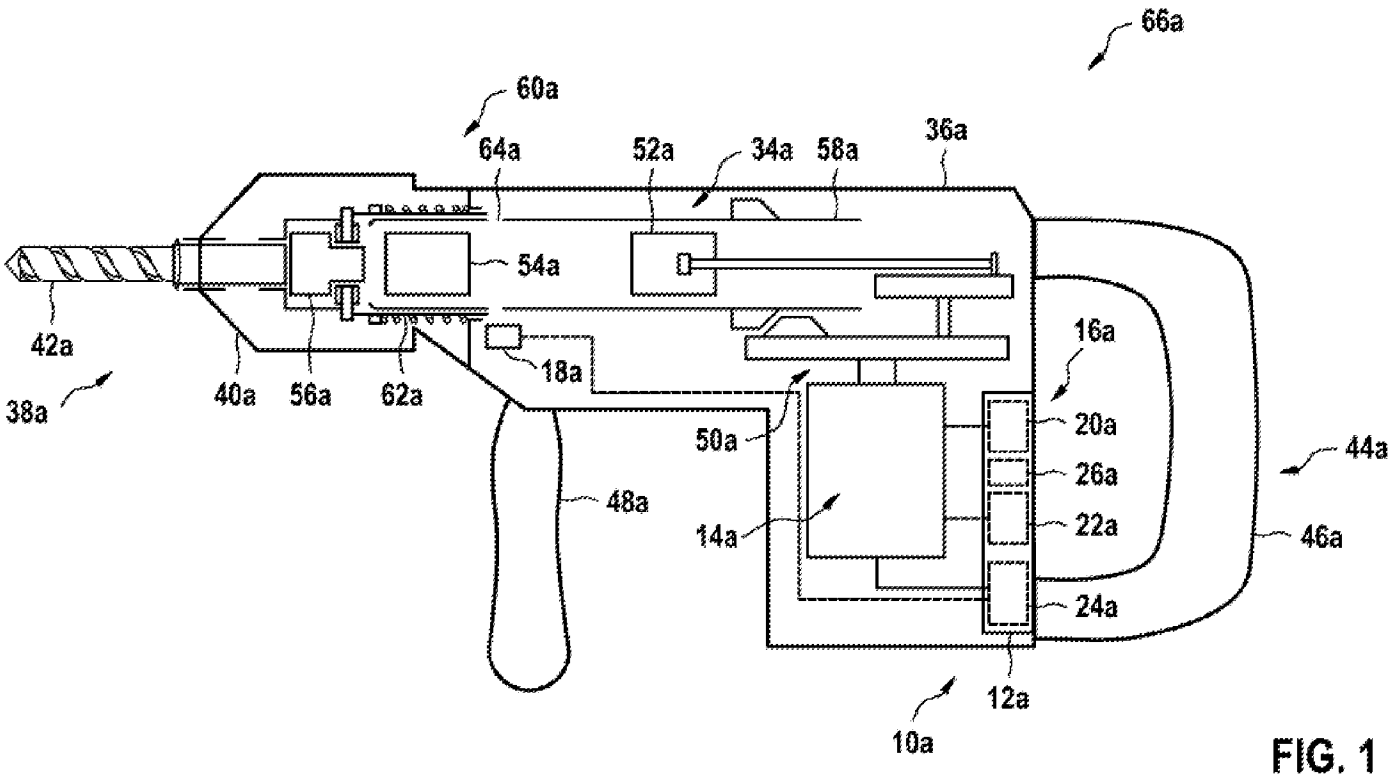
FIG. 1 a machine tool according to the disclosure with at least one machine-tool device according to the disclosure in a schematic representation, FIG. 2 a detailed view of the machine-tool device according to the disclosure in a schematic representation, FIG. 3 a detailed view of an alternative machine-tool device according to the disclosure in a schematic representation, FIG. 4 a detailed view of another alternative machine-tool device according to the disclosure in a schematic representation, and FIG. 5 a detailed view of another alternative machine-tool device according to the disclosure in a schematic representation.

FIG. 1 shows a machine tool 66*a* which takes the form of a drilling hammer and/or chipping hammer. Consequently the machine tool 66*a* takes the form of a manual machine tool. However, it is also conceivable that in an alternative configuration, not represented here, the portable machine tool 66*a* takes the form of a demolition hammer or another manual machine tool appearing appropriate to a person skilled in the art. The machine tool 66*a* includes at least one striking-mechanism device 34*a*. The striking-mechanism device 34*a* has been represented in FIG. 1 merely schematically, in order to elucidate a mode of operation. Furthermore, the machine tool 66*a* includes a machine-tool housing 36*a* on which, in a front region 38*a*, a tool socket 40*a* of the striking-mechanism device 34*a* has been arranged for accommodation of an insertion tool 42*a*. On a side 44*a* facing away from the front region 38*a* the machine tool 66*a* includes a main grip 46*a* for guidance of the machine tool 66*a* and for transmission of a force, in particular a pressure force, from an operator to the machine tool 66*a*. The machine tool 66*a* has furthermore been constructed with a detachable auxiliary grip 48*a*. In this regard, the auxiliary grip 48*a* may have been detachably secured to the machine-tool housing 36*a* via a detent connection or another connection appearing appropriate to a person skilled in the art.

For generation of a drive torque and for generation of a striking impulse by means of the striking-mechanism device 34*a*, the machine tool 66*a* exhibits a drive unit 14*a*. Via an output unit 50*a* of the machine tool 66*a*, a drive torque of the drive unit 14*a* for generating a striking impulse is transmitted to the striking-mechanism device 34*a*. However, it is also conceivable that the portable machine tool 66*a* has been designed to be decoupled from the output unit 50*a*, and the drive unit 14*a* acts substantially directly on the striking-mechanism device 34*a* for generation of a striking impulse. A striking impulse of the striking-mechanism device 34*a* is generated in a manner already known to a person skilled in the art. In this regard, by means of a reciprocating motion of a striking-impulse element 52*a* of the striking-mechanism device 34*a* taking the form of a piston, in at least one striking mode of the striking-mechanism device 34*a* a pressure is generated for motion of a further striking-impulse element 54*a* of the striking-mechanism device 34*a* taking the form of a striker, which is provided for transmission of a striking impulse to a striking pin 56*a* of the striking-mechanism device 34*a*. Furthermore, via the output unit 50*a* the drive torque for generation of a rotary motion of the insertion tool 42*a* is transmitted to the tool socket 40*a* via a guide element 58*a* of the striking-mechanism device 34*a* taking the form of a hammer tube and/or via a rotary-entrainment element (not represented in any detail here) arranged on the tool socket 40*a*.

The striking-mechanism device 34*a* for the machine tool 66*a* comprises at least the striking-impulse element 52*a*, at least the guide element 58*a* for guidance of the striking-impulse element 52*a*, and at least one idling-opening control unit 60*a* which exhibits at least one movably supported idling-opening control element 62*a* for opening and/or for closing at least one idling opening 64*a* of the guide element 58*a*. The idling-opening control unit 60*a* in this case takes the form of a sleeve-type control unit. Consequently the idling-opening control element 62*a* takes the form of an idling control sleeve. In an idling mode of the striking-mechanism device 34*a*, in which the idling opening 64*a* is open and consequently unsealed by the idling-opening control element 62*a*, the striking-impulse element 52*a* taking the form of a piston moves in translation within the guide element 58*a*, taking the form of a hammer tube, from a front dead-center point to a rear dead-center point. However, it is also conceivable that the striking-impulse element 52*a* taking the form of a piston takes the form of a pot-type piston and in the idling mode of the striking-mechanism device 34*a* moves in translation relative to other components of the striking-mechanism device 34*a* which are guided in the pot-type piston, or relative to the machine-tool housing 36*a*, from a front dead-center point to a rear dead-center point. By this means, a striking impulse is generated as a consequence of a drive of the striking-impulse element 52*a* taking the form of a piston. For vibration damping, it is conceivable that the machine tool 66*a* includes a damping unit (not represented in any detail here). In this case the damping unit is provided to damp an oscillation that is capable of being transmitted to an operator of the machine tool 66*a*.

Moreover, the machine tool 66*a* includes at least one machine-tool device 10*a* for control and/or regulation of the machine tool 66*a*. The machine-tool device 10*a* takes the form of a manual machine-tool device. In this case, the machine-tool device 10*a* comprises at least one control and/or regulation unit 12*a*, for control and/or regulation of a drive unit 14*a*, and at least one sensor unit 16*a*, which includes at least one sensor element 18*a* taking the form of an acceleration sensor. By means of sensor element 18*a* taking the form of an acceleration sensor, an acceleration of the machine tool 66*a* caused by the striking-mechanism device 34*a* can be registered. In this connection, sensor element 18*a* taking the form of an acceleration sensor is provided to register at least one acceleration proceeding in the striking direction and/or contrary to the striking direction of the striking-mechanism device 34*a*. In this connection, in a striking mode of the striking-mechanism device 34*a* the acceleration results from a periodic impact generated by the striking-mechanism device 34*a*. In an idling mode, the acceleration results from a reciprocating motion of the striking-impulse element 52*a* taking the form of a piston. This acceleration can be registered in each instance with sensor element 18*a* taking the form of an acceleration sensor.

Figure 2:
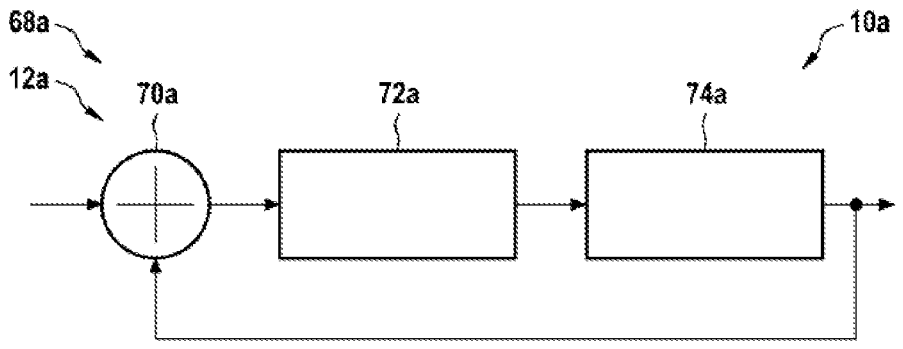
Figure 3:
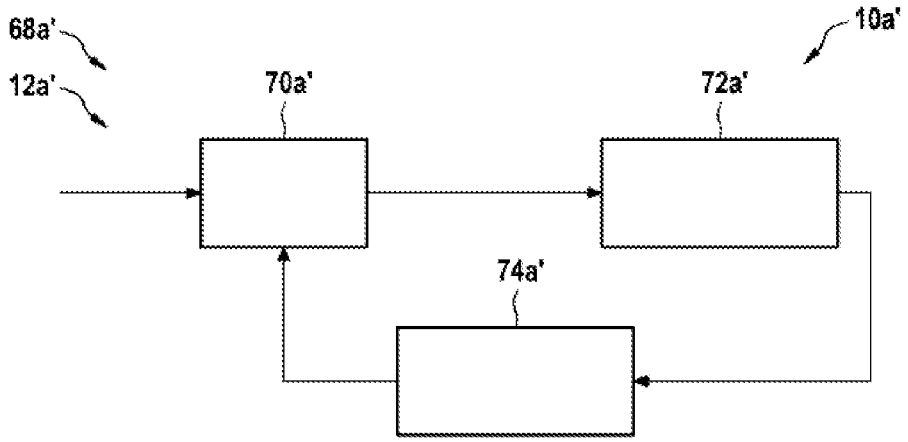

The control and/or regulation unit 12*a* is provided at least to determine at least one actual rotational speed of the drive unit 14*a* from a signal of sensor element 18*a* taking the form of an acceleration sensor. For this purpose, the control and/or regulation unit 12*a* exhibits a phase-locked-loop unit 68*a* (FIG. 2) which is provided to determine a frequency from a signal registered by sensor element 18*a* taking the form of an acceleration sensor. Alternatively, it is conceivable that the control and/or regulation unit 12*a* includes, instead of the phase-locked-loop unit 68*a*, a Fourier-analysis unit or a frequency-comb unit for determination of a frequency from a signal registered by sensor element 18*a* taking the form of an acceleration sensor. In addition, a determination of rotational speed by means of a method for determination of a period of time from a time signal is conceivable, in which a time between two signal peaks or two zero crossings of the acceleration signal is measurable and a frequency is ascertainable therefrom. Depending on a signal quality, in this connection a preprocessing by means of a band-pass filter is appropriate. Alternatively, the time between several signal peaks or zero crossings is ascertainable, by virtue of which the calculated frequency has been averaged over several periods. The phase-locked-loop unit 68*a* comprises at least one phase detector 70*a*, a loop filter 72*a* and a voltage-controlled oscillator 74*a*. Consequently the phase-locked-loop unit 68*a* takes the form of an analog phase-locked-loop unit 68*a*. In a variant, represented in FIG. 3, of the phase-locked-loop unit 68*a*' the phase-locked-loop unit 68*a*' exhibits a phase detector 70*a*', a loop filter 72*a*' and a numerically controlled oscillator 74*a*'. Consequently the variant of the phase-locked-loop unit 68*a*' represented in FIG. 3 has been implemented as a digital phase-locked-loop unit 68*a*'. Consequently a frequency can be determined in structurally simple manner from a signal registered by sensor element 18*a* taking the form of an acceleration sensor. From this frequency, the control and/or regulation unit 12*a* calculates an actual rotational speed of the drive unit 14*a*. Consequently, in a method for control and/or regulation of a rotational speed of the drive unit 14*a* of the machine tool 66*a* at least one frequency of a periodic acceleration is determined by means of the control and/or regulation unit 12*a*, by means of which frequency an actual rotational speed of the drive unit 14*a* can be determined. In addition, the control and/or regulation unit 12*a* is provided at least to adjust a rotational speed of the drive unit 14*a* as a function of a signal of sensor element 18*a* taking the form of an acceleration sensor.

Moreover, the sensor unit 16*a* exhibits at least one further sensor element 20*a* taking the form of a current sensor. The further sensor element 20*a* taking the form of a current sensor is provided here to register a current consumed by the drive unit 14*a*. A current value registered by the further sensor element 20*a* taking the form of a current sensor is transmitted to the control and/or regulation unit 12*a*. The control and/or regulation unit 12*a* is provided at least to adjust a rotational speed of the drive unit 14*a* as a function of a signal of sensor element 18*a* taking the form of an acceleration sensor and as a function of a signal of the further sensor element 20*a* taking the form of a current sensor. Furthermore, the sensor unit 16*a* includes at least one additional sensor element 22*a* taking the form of a voltage sensor. The additional sensor element 22*a* taking the form of a voltage sensor is provided here to register a voltage picked up by the drive unit 14*a*. A voltage value registered by the additional sensor element 22*a* taking the form of a voltage sensor is transmitted to the control and/or regulation unit 12*a*. The control and/or regulation unit 12*a* is consequently provided at least to adjust a rotational speed of the drive unit 14*a* as a function of a signal of sensor element 18*a* taking the form of an acceleration sensor, as a function of a signal of the further sensor element 20*a* taking the form of a current sensor, and as a function of a signal of the additional sensor element 22*a* taking the form of a voltage sensor.

Figure 4:
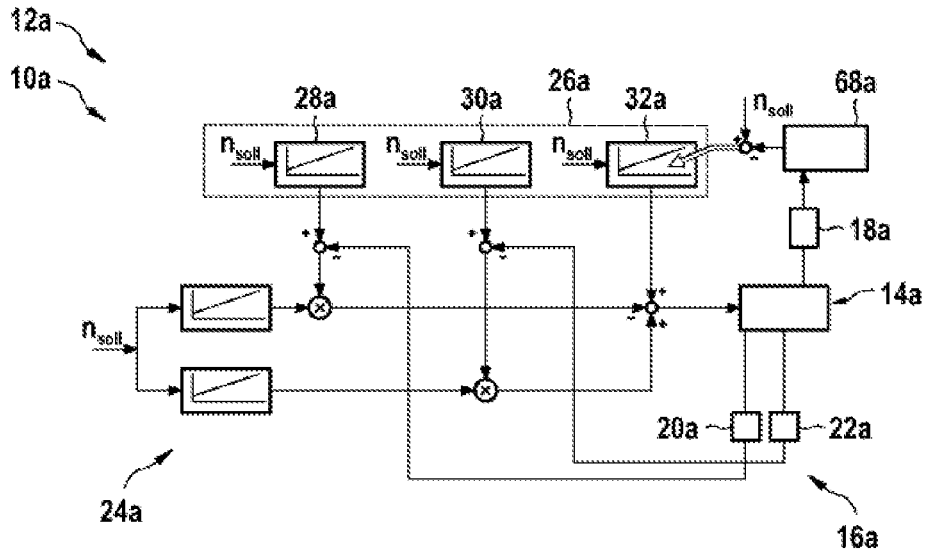

In addition, the control and/or regulation unit 12*a* includes at least one voltage and/or current regulator 24*a* for adjustment of the rotational speed of the drive unit 14*a*, which is provided to take into account a characteristic quantity of the rotational speed that has been generated from a signal of sensor element 18*a* taking the form of an acceleration sensor (FIG. 4). In this connection, the voltage and/or current regulator 24*a* is provided to take into account at least one actual rotational speed of the drive unit 14*a* calculated by means of the control and/or regulation unit 12*a* from the signal of sensor element 18*a* taking the form of an acceleration sensor. In addition, for adjustment of the rotational speed of the drive unit 14*a* the voltage and/or current regulator 24*a* takes into account the signals of the further sensor element 20*a* taking the form of a current sensor, and of the additional sensor element 22*a* taking the form of a voltage sensor. However, it is also conceivable that for adjustment of the rotational speed of the drive unit 14*a* the control and/or regulation unit 12*a* calculates from an ignition point of the drive unit 14*a* a drive-unit voltage that can be made available to the voltage and/or current regulator 24*a* as an alternative to the signal of the additional sensor element 22*a* taking the form of a voltage sensor for adjustment of the rotational speed of the drive unit 14*a*.

The regulation of the rotational speed of the drive unit 14*a* is consequently undertaken by means of the voltage and/or current regulator 24*a*. In this connection, an actual rotational speed of the drive unit 14*a* is determined at regular time-intervals from a signal of sensor element 18*a* taking the form of an acceleration sensor and is transmitted to the voltage and/or current regulator 24*a*. The actual rotational speed of the drive unit 14*a* is furthermore compared by means of the voltage and/or current regulator 24*a* with a set rotational speed of the drive unit 14*a* which has been saved in a memory unit 26*a* of the control and/or regulation unit 12*a* and which is specific for a mode, such as, for example, a striking mode and/or an idling mode. If a deviation is established by the control and/or regulation unit 12*a*, control parameters are changed in such a manner that the deviation is kept small. The change (adaptation) of the control parameters is undertaken in this case by at least an order of magnitude that is slower than a regulation of the voltage and/or current regulator 24*a*, so that no reaction of the adaptation occurs on the regulation by means of the voltage and/or current regulator 24*a*. The adaptation is preferentially carried out only in a steady state, i.e. when an output signal of the voltage and/or current regulator 24*a* no longer changes or changes slightly. For this purpose, several parameter characteristics 28*a*, 30*a*, 32*a* have been saved in the memory unit 26*a*. For adjustment of the rotational speed of the drive unit 14*a*, the voltage and/or current regulator 24*a* accesses the parameter characteristics 28*a*, 30*a*, 32*a* saved in the memory unit 26*a*. The parameter characteristics 28*a*, 30*a*, 32*a* can be evaluated for calculation of an ignition point of the drive unit 14*a*. In order in steady operation to obtain exactly a desired set rotational speed of the drive unit 14*a*, at least one of the parameter characteristics 28*a*, 30*a*, 32*a* can be adapted by means of the control and/or regulation unit 12*a*. If, for example, an actual rotational speed is greater than a set rotational speed of the drive unit 14*a*, then an applied drive-unit voltage is too high and consequently a value of the ignition point is too low. One of the parameter characteristics 28*a*, 30*a*, 32*a*, in particular a parameter characteristic defining a set ignition point, is adapted by being shifted upward by an offset. The offset is, for example, proportional to a difference between a set speed and an actual speed of the drive unit 14*a* calculated from the signal of sensor element 18*a* taking the form of an acceleration sensor. After several adaptation steps, one of the parameter characteristics 28*a*, 30*a*, 32*a* has been set in such a way that the ignition point calculated by the voltage and/or current regulator 24*a* provides an exact drive-unit voltage, so that the drive unit 14*a* runs at the desired set speed. Alternatively, it is conceivable that several parameter characteristics 28*a*, 30*a*, 32*a* are adapted simultaneously or successively, or that the parameter characteristics 28*a*, 30*a*, 32*a* are not only shifted upward or downward by an offset, but a slope of the saved parameter characteristics 28*a*, 30*a*, 32*a* varies. Consequently the control and/or regulation unit 12*a* carries out at least one adaptation of a parameter characteristic 28*a*, 30*a*, 32*a* of the drive unit 14*a*, saved in a memory unit 26*a* of the control and/or regulation unit 12*a*, for adjustment of a set rotational speed of the drive unit 14*a*. In addition, it is conceivable that at least one operating-condition-dependent rotational speed has been saved in the memory unit 26*a*, which is adapted as a function of an operating condition of the striking-mechanism device 34*a* for adjustment of the rotational speed of the drive unit 14*a*.

Moreover, a recognition of impact is possible by means of the machine-tool device 10*a*. This is undertaken via sensor element 18*a* taking the form of an acceleration sensor in combination with sensor element 20*a* taking the form of a current sensor. In this case, an increase in an acceleration value from the idling mode of the striking-mechanism device 34*a* relative to the striking mode of the striking-mechanism device 34*a* can be registered by means of sensor element 18*a* taking the form of an acceleration sensor. The increase in the acceleration value occurs in a striking direction of the insertion tool 42*a* and lies within a frequency range of a striking frequency. By means of sensor element 20*a* taking the form of a current sensor, the striking mode of the striking-mechanism device 34*a* can be registered via an increased current consumption of the drive unit 14*a*. The current level is dependent on a rotational speed of the drive unit 14*a* and on an operating condition of the striking-mechanism device 34*a*. As a consequence of a signal of sensor element 18*a* taking the form of an acceleration sensor, an actual rotational speed can be determined, as already described above. In addition, by means of a registration of a current consumption of the drive unit 14*a* by means of sensor element 20*a* taking the form of a current sensor, an operating condition of the striking-mechanism device 34*a* can be inferred. By virtue of the fact that the current level is dependent on a rotational speed of the drive unit 14*a* and on an operating condition of the striking-mechanism device 34*a*, a reliable and precise recognition of an operating condition of the striking-mechanism device 34*a* can consequently be made possible.

Figure 5:
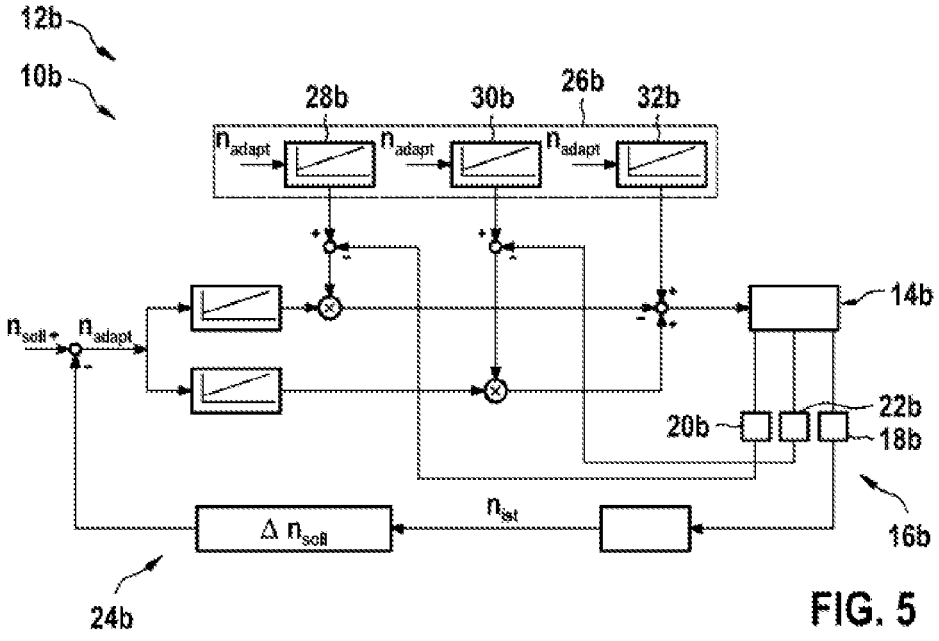

FIG. 5 shows a further embodiment of the disclosure. The following descriptions and the drawings are substantially restricted to the differences between the embodiments, in which connection with reference to identically labelled components, in particular with respect to components having identical reference symbols, reference may also be made, in principle, to the drawings and/or to the description of the other embodiments, in particular the description of FIGS. 1 to 4. For the purpose of distinguishing the embodiments, the letter "a" has been appended to the reference symbols pertaining to the embodiment in FIGS. 1 to 4. In the embodiment shown in FIG. 5, the letter "a" has been replaced by the letter "b".

An alternative machine-tool device 10*b* is represented in FIG. 5. In this case the machine-tool device 10*b* can be arranged, in a manner analogous to that in the description of FIGS. 1 to 4, in a manual power tool (not represented here in any detail). The machine-tool device 10*b* comprises at least one control and/or regulation unit 12*b*, for control and/or regulation of a drive unit 14*b*, and at least one sensor unit 16*b*, which includes at least one sensor element 18*b* taking the form of an acceleration sensor. In this connection the control and/or regulation unit 12*b* is provided at least to determine at least one actual rotational speed of the drive unit 14*b* from a signal of sensor element 18*b* taking the form of an acceleration sensor. An adjustment of the rotational speed of the drive unit 14*b* is undertaken here in a manner at least substantially analogous to the adjustment of the rotational speed described in the description of FIGS. 1 to 4. In contrast to the adjustment of the rotational speed described in FIGS. 1 to 4, in the case of the machine-tool device 10*b* described in FIG. 5 an adjustment of the rotational speed is undertaken by an adaptation of a set rotational speed of the drive unit 14*b* which has been transferred to a voltage and/or current regulator 24*b* of the control and/or regulation unit 12*b*. In this case, the set rotational speed of the drive unit 14*b* is transferred to the voltage and/or current regulator 24*b* which calculates therefrom an ignition point of the drive unit 14*b*. A control loop is extended in such a way that the voltage and/or current regulator 24*b* falls back not on a set rotational speed desired by an operator but rather on an adapted set rotational speed of the drive unit 14*b*. If in the steady state an actual rotational speed of the drive unit 14*b* is greater than the set rotational speed desired by the operator, the adapted rotational speed is decreased by one step. The voltage and/or current regulator 24*b* consequently registers a lower set rotational speed in a next step of the calculation and adjusts a drive-unit voltage of the drive unit 14*b* to a lower value by means of the ignition point. Such an adaptation step is chosen, for example, to be proportional to a difference between the set rotational speed desired by an operator and the actual rotational speed of the drive unit 14*b*. By this means, in the long term an adapted set rotational speed arises in such a manner that the actual rotational speed corresponds identically to the set rotational speed desired by the operator. In the event of a change from an idling mode to a striking mode, or conversely, for each rotational-speed stage a specific value of an adapted set rotational speed of the drive unit 14*b* is adjusted. In the event of a renewed change from an idling mode to a striking mode, or conversely, a new adaptation is carried out. If a change is made back to an operating mode already chosen previously, the already adapted value of the adapted set rotational speed continues to be used. With regard to further features and functions of the machine-tool device 10*b*, reference may be made to the description of FIGS. 1 to 4.

The invention claimed is:

1. A drilling hammer comprising:

a drive unit;

a tool socket operably connected to the drive unit and configured to be rotated by the drive unit;

a striking-mechanism device operably connected to the drive unit and configured to drive a striking-impulse element via a drive torque of the drive unit to generate a striking impulse having a periodic acceleration;

an acceleration sensor configured to generate an acceleration signal based on the periodic acceleration; and at least one control and/or regulation unit operably connected to the drive unit and the acceleration sensor, the control and/or regulation unit configured to (i) control rotation of the drive unit at a set rotational speed, (ii) determine an actual rotational speed of the drive unit from a frequency of the periodic acceleration of the striking-impulse element, (iii) determine a difference between the set rotational speed and the actual rotational speed, and (iv) adapt the actual rotational speed to correspond to the set rotational speed based on the determined difference.

2. The drilling hammer as claimed in claim 1, wherein the control and/or regulation unit is further configured to adjust the actual rotational speed of the drive unit as a first function of the acceleration signal of the acceleration sensor.

3. The drilling hammer as claimed in claim 1, further comprising a current sensor operably connected to the control and/or regulation unit and configured to generate a current signal based on a current consumed by the drive unit.

4. The drilling hammer as claimed in claim 3, wherein the control and/or regulation unit is further configured to adjust the actual rotational speed of the drive unit as a first function of the acceleration signal of the acceleration sensor and as a second function of the current signal of the current sensor.

5. The drilling hammer as claimed in claim 3, further comprising a voltage sensor operably connected to the control and/or regulation unit and configured to generate a voltage signal based on a voltage of the drive unit.

6. The drilling hammer as claimed in claim 5, wherein the control and/or regulation unit is further configured to adjust the actual rotational speed of the drive unit as a first function of the acceleration signal of the acceleration sensor, as a second function of the current signal of the current sensor, and as a third function of the voltage signal of the voltage sensor.

7. The drilling hammer as claimed in claim 1, wherein the control and/or regulation unit includes at least one voltage and/or current regulator configured to adapt the actual rotational speed of the drive unit based on a characteristic quantity of the actual rotational speed determined from the acceleration signal of the acceleration sensor.

8. A method for at least one of controlling and regulating a rotational speed of a drive unit of a drilling hammer including the drive unit, a tool socket operably connected to the drive unit, a striking-mechanism device operably connected to the drive unit, an acceleration sensor, and at least one control and/or regulation unit operably connected to the drive unit, the method comprising:

controlling rotation of the drive unit at a set rotational speed with the at least one control and/or regulation unit;

driving a striking-impulse element of the striking-mechanism device via a drive torque of the drive unit to generate a striking impulse having a periodic acceleration;

determining an actual rotational speed of the drive unit from a frequency of the periodic acceleration of the striking-impulse element with the at least one control and/or regulation unit;

determining a difference between the set rotational speed and the actual rotational speed with the at least one control and/or regulation unit; and adapting the actual rotational speed to correspond to the set rotational speed based on the determined difference with the at least one control and/or regulation unit.

9. The method as claimed in claim 8, wherein:

the control and/or regulation unit is configured to adapt a parameter characteristic of the drive unit to adapt the set rotational speed of the drive unit, and the parameter characteristic of the drive unit is saved in a memory unit of the control and/or regulation unit.

10. The drilling hammer as claimed in claim 1, wherein the periodic acceleration is parallel to an axis of rotation of the drive unit.

11. The method as claimed in claim 8, further comprising:

sensing the acceleration with the acceleration sensor along an axis that is parallel to an axis of rotation of the drive unit.

* * * * *